United States Patent [19]

Kifferstein

[11] 4,278,248

[45] Jul. 14, 1981

[54] RHYTHM INDICATING EXERCISERS

[76] Inventor: Harry P. Kifferstein, 27250 Harvard Rd., Southfield, Mich. 48076

[21] Appl. No.: 51,113

[22] Filed: Jun. 22, 1979

[51] Int. Cl.[3] ..... A63B 21/00

[52] U.S. Cl. ..... 272/68; 272/70; 272/117; 46/193

[58] Field of Search ..... 272/117, 93, 122, 123, 272/128, 67, 70, 68, 124; 46/193, 191

[56] References Cited

U.S. PATENT DOCUMENTS

| | | | |
|---|---|---|---|
| 466,276 | 12/1891 | Le Garde | 272/122 |
| 729,064 | 5/1903 | Hale | 272/122 X |
| 907,965 | 12/1908 | Calvert | 272/122 |
| 980,025 | 12/1910 | Titus | 272/122 |
| 1,552,073 | 9/1925 | Mansfeldt | 272/122 |
| 1,918,142 | 7/1933 | Smith | 272/122 |
| 2,268,684 | 1/1942 | Zadek | 46/193 |
| 2,509,810 | 5/1950 | Core | 272/122 |
| 3,006,646 | 10/1961 | Nanni | 272/67 |
| 3,318,460 | 5/1963 | Brief | 46/191 |
| 3,488,051 | 1/1970 | Scherer | 272/122 |
| 3,514,898 | 6/1970 | Price | 46/191 |
| 3,746,336 | 7/1973 | Tanimoto | 272/67 |
| 4,218,057 | 8/1980 | Wilson | 272/117 |

*Primary Examiner*—Richard J. Johnson

*Attorney, Agent, or Firm*—Hsuke and Patalidis

[57] ABSTRACT

A rhythm indicating exercising device in the form of a generally tubular member having a preferably metallic mass or slug disposed freely slidable in the interior of the tubular member, each end of the tubular member being provided with an arresting member or end closure preventing the mass or slug from escaping from the tubular member. In use, one tubular member is grasped in one hand or, preferably, a pair of tubular members are held one in each hand of a person while walking and more particularly while engaged in aggressive exercise walking, that is while walking at a fast pace with extensive swinging of the arms back and forth. At the end of each forward and backward stroke of the arm, the mass or slug is forcibly propelled by inertia within the tubular member and caused to strike the corresponding arresting member or end closure, thus producing an impact knocking sound helping the walker to maintain an effective rhythm and providing beneficial advantages in indicating proper exercising of the arms in addition to the legs.

30 Claims, 18 Drawing Figures

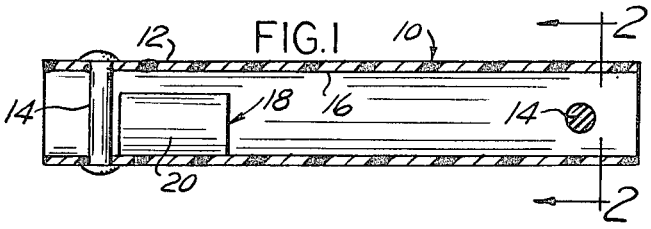
FIG.1
12
10
2
14
18
16
14
20
2
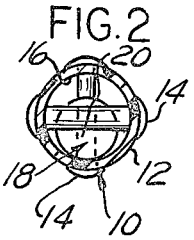
FIG.2
16
20
14
18
12
14
10
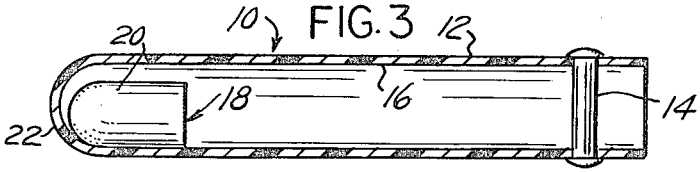
FIG.3
10
12
20
18
16
14
22
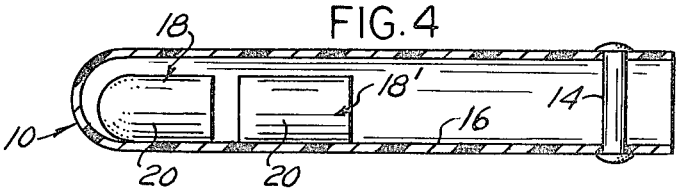
FIG.4
18
18'
14
16
10
20
20
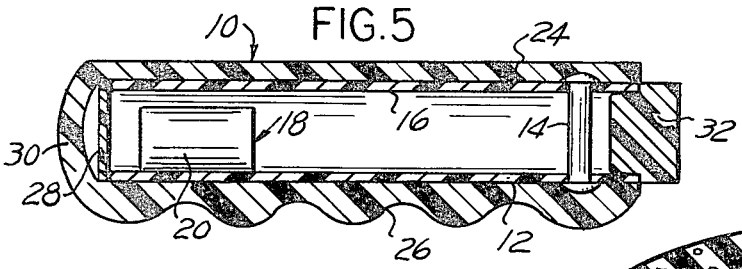
FIG.5
10
24
18
16
14
32
30
28
20
26
12
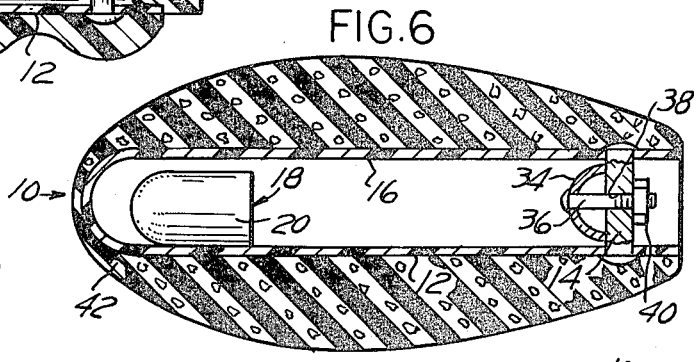
FIG.6
38
10
18
16
34
36
20
42
12
14
40
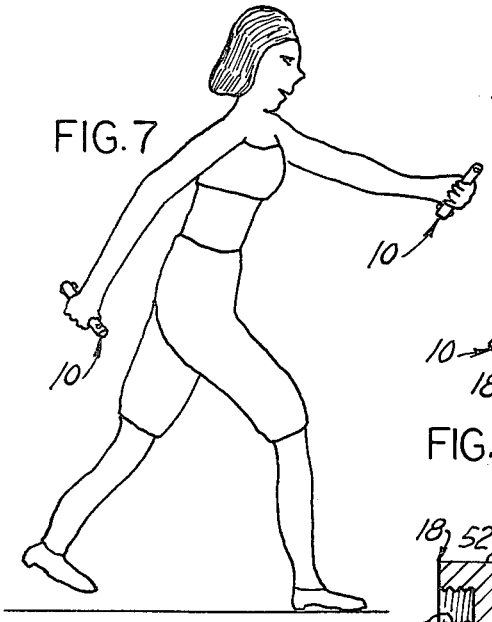
FIG.7
10
10
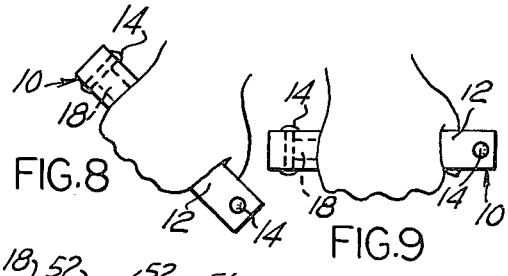
14
10
18
12
14
FIG.8
14
12
18
14
10
FIG.9
10
14
18
12
14
FIG.10
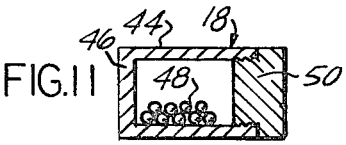
FIG.11
46
44
18
48
50
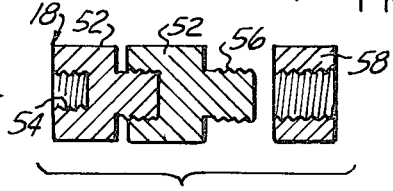
18
52
52
56
58
54
FIG.12
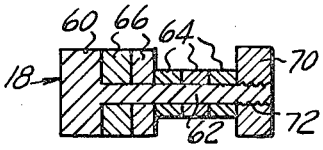
60
66
64
70
18
72
62
FIG.13

RHYTHM INDICATING EXERCISERS

BACKGROUND OF THE PRESENT INVENTION

Recent years have witnessed a remarkable growth in an occupation, aptly called "jogging", which is best enjoyed, or suffered, solitarily, although sometimes practiced in pair or in groups. Some social observers have pounderously qualified jogging as a way of life, a philosophy, a mystique, a fad, a cult, or simply a form of snobbism, rather than a sport or a search for physical form, fitness and well-being. Joggers of all ages, sizes, cultural and ethnic backgrounds, colors and denominations, have invaded highways, country roads, streets, avenues, parks, parking lots and cemeteries. Even the fashion industry has been influenced by jogging.

As many rural and urban, but sedentary, observers have sarcastically remarked, jogging has opened new chapters on modern mankind's perpetual pursuit for happiness and physical fitness. One advantage of jogging is that it requires no auxiliary equipment whatsoever, short of an appropriate fashionable preferably bright color garb. Jogging nevertheless appears to be a healthfully beneficial endeavor and to provide a good muscular and cardiovascular exercise resulting in improved stamina, intensified perspiration and consequential loss of undesirable and undesired weight through active burning of body fat and elimination of tissue water. However, jogging has many inconveniences and pitfalls which, at times, seem to prove that only the fittest deserve to survive arrhythmia, tachycardia, ventricular fibrilation, hyperventilation, muscle cramps, endurance fatigue and stress, kidney and urinary disorders, stomach and intestinal problems, feet blistering, carbon monoxide inhalation, broken bones, worn-out joints, chronic joint and lung inflamation, ruptured ligaments and tendons and dog bites. Joggers also tend to demonstrate complete disregard for collisions with immobile objects such as signposts, lampposts, benches, fire hydrants and garbage cans, as well as with mobile objects such as dogs, pedestrians, bicycles, motorcycles, taxicabs, horse carriages, automobiles, buses and subway trains.

An alternate to jogging is walking. Walking is a natural human action which, while still enjoyed by a small proportion of the highly motorized human bipeds scurrying around at the bottom of the canyons of modern metropolis, has fallen into disrepute in view of the more conventional alternative provided by the fossil energy consuming mass and private transportation system. This disrepute has reached the point that walking, one of man's and woman's most natural functions, is often casually prescribed by physicians ironically for its therapeutic value. Walking, however, does not require any special equipment or field, court, rink, course or pool. Walking does not require any special clothing, garb, or uniform.

Long distance walking, or marathon walking, is a very popular competitive sport long practiced in many countries, recognized by sporting clubs and associations, and rewarded by national and international championships. Such competitive aggressive fast-paced walking takes place under strict rules, one of which requiring that each step be effected with the heel of the foot first contacting the ground. Competitive marathon walkers, or marchers, are, in the course of an officially sponsored contest, under constant observation and scrutiny by umpires and referees and immediately disqualified if violating any of the rules.

Competitive walkers, or marchers, walk at a rhythmic pace and fling their extended arms, using their shoulders as pivots, in synchronized timing with the walking legs, the right and left arms swinging rhythmically in opposite directions to the strides of respectively right and left legs. In other words, simultaneously with throwing his or her right leg forward, the competitive walker throws his or her right arm backward and his or her left arm forward, and vice-versa. Competitive walkers are complete athletes, with fully developed muscles in the arms, neck, shoulders, upper and lower back, chest, belly as well as the legs.

Without engaging into such an aggressive competitive walking, any average person can achieve his or her sought-after physical fitness, and in addition benefits from greatly improved muscular functions, strengthened heart muscles, and increased cardiac output, pulmonary capacity and physical stamina and endurance, by exercising through aggressive walking without suffering the inconveniences, pains and side effects of jogging. Although walking, like bicycling, may be enjoyed at a leisurely pace, it may be practiced in a somewhat vigorous and aggressive manner, in the form of an exercise, in order to attain all of the expected physical and health advantages. It has been noted, however, that most "amateur" walkers tend to be originally lax in properly and vigorously swinging their arms in time with their leg strides or, if at first somewhat energetic in their arm action, they tend to become progressively lax after a short period of time.

There is therefore a need for an exercising device for aiding an aggressive walker to achieve proper motion-timing and, in addition, providing an indicator of adequate arm motions in synchronism with leg motions. The present invention provides such a rhythm indicator, arm exerciser and detector of proper arm actions for a person engaged in practicing vigorous aggressive walking while, at the same time, providing him or her with a relatively light hand-supported load, which, if so desired, can be progressively increased as arm and shoulder muscles develop.

SUMMARY OF THE INVENTION

The principal object of the present invention is to provide a simple hand graspable unit which functions as a rhythm indicator and as a detector of proper swinging of the arms during vigorous aggressive walking, and which can be used as a training tool for the average person attempting to improve his or her physical well-being and aptitudes as well as for the athlete aiming at improved performance. The diverse objects and advantages of the present invention will become apparent to those skilled in the art when the following description of examples of the best modes contemplated for practicing the invention is read in conjunction with the accompanying drawing wherein:

BRIEF DESCRIPTION OF THE DRAWINGS

FIG. 1 is a longitudinal section through an example of structure according to the present invention;

FIG. 2 is a cross-section along line 2—2 of FIG. 1;

FIG. 3 is a longitudinal section through a modification thereof; FIG. 4 is a longitudinal section through a further modification thereof;

FIG. 5 is a longitudinal section through another modification thereof;

FIG. 6 is a longitudinal section through another modification thereof;

FIG. 7 is a schematic view of a person engaged in vigorous aggressive walking while using the present invention;

FIGS. 8–10 illustrate different positions of a hand of an aggressive walker while using the present invention;

FIGS. 11–13 illustrate examples of adjustable weight masses for use in the present invention.

DETAILED DESCRIPTION OF THE PREFERRED EMBODIMENT

Figure 14:
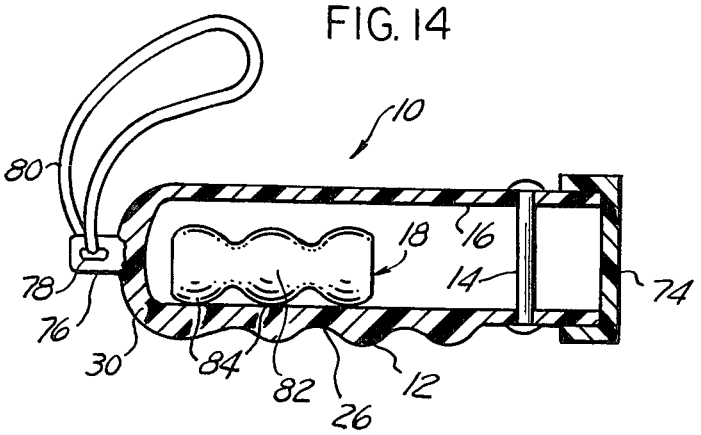
FIGS. 14–18 are longitudinal sections through further modifications of structure according to the present invention.

The rhythm indicator and exercising device 10 of the present invention is generally, as shown in the drawing and more particularly at FIGS. 1-2, in the form of a straight tubular member 12 open at both ends and provided proximate each end with a diametrically disposed stop member in the form of a metallic rod such as an elongated rivet 14. The tubular member 12 may be made of metal but, preferably, it is made of a plastic extrusion of a diameter, such as one to two inches, appropriate to be gripped by a hand. A convenient material for making the tubular member 12 is polyethylene tubing, or the like, cut to length, for example four to six inches. In the internal bore 16 of the tubular member 12 a weighted mass 18, in the form of a metallic slug 20, is loosely disposed. The slug 20 has an outer diameter smaller than the inner diameter of the tubular member bore 16 and preferably having at least one dimension greater than one half the internal diameter of the tubular member such as to be freely displaceable from one end of the tubular member 12 to the other, and is prevented from being thrown out of the tubular member 12 in any position of the tubular member by abutment against the appropriate stop member or rivet 14.

Instead of a tubular member 12 open at both its ends, a tubular member 12 closed at one end by way of an integral closure wall 22 may be used, as shown at FIGS. 3 and 4 and, instead of a single weight mass 18, a pair of weighted masses as shown at 18 and 18' at FIG. 4, or more if so desired, may be disposed in the tubular member bore 16. For improved manual grasp, the tubular member 12 may be provided on its peripheral surface with an appropriate grip sleeve made of rubber or other convenient material such as polypropylene or the like. Such an example of structure is illustrated at FIG. 5 wherein the tubular member 12, made for example of polyethylene or the like, is enclosed in a tubular sleeve 24 made of resilient material and provided with indentations such as shown at 26, forming a firm hand grip. In the structure of FIG. 5, the tubular member 12 is open at both ends and one end is provided with a stop or abutment member such as the diametrically disposed rod or rivet 14, and the other end is provided with a metallic disk 28 held in position by the resilient sleeve 24 which has an integral closed end 30. The end of the tubular member 12 provided with the diametrically disposed rod or rivet 14 is closed by a cap 28 press-fitted or similarly engaged in the end of the tubular member 12 or appropriately threaded in the end, for improved appearance.

It will be readily apparent that other means than a rod or rivet 14 may be used as an end closure for the tubular member 12. A metallic disk, a diametrically disposed screw, or the like, are effective as a stop or abutment means. If so desired, a sound-emitting member such as a hemispherical bell can also be used. Such a structure is illustrated at FIG. 6 wherein the end closure rod or rivet 14 at the open end of the tubular member 12 supports a hemispherical metallic cup 34 provided with a stem 36 projecting through an aperture 38 in the rivet 14 and held in position by means of a nut 40 threading on the threaded end portion of the stem 36. In addition, the structure of FIG. 6 comprises a resilient elastomeric sleeve 42, in the general form of a bulb, disposed around the tubular member 12, such that when the exercising device 10 is manually grasped finger muscles may also be exercised, while walking, by squeezing the bulbous resilient sleeve 42. The bulbous sleeve 42 may take the form of a hollow air filled bulb or, alternatively and as illustrated at FIG. 6, it may be made of a foam rubberized or elastomeric plastic material.

Referring to FIG. 7, there is illustrated a walker engaged in vigorous aggressive walking while holding in each hand a rhythm indicator exercising device 10 according to the present invention in general and more specifically according to the embodiment of FIGS. 1-2. In order to properly exercise the upper torso and more particularly the back, the chest, the shoulder and the arm muscles, and in order to establish proper balance and natural stride while engaging in aggressive walking, while the right leg, for example is propelled forwardly, the right arm is swung vigorously backwards, the end of the backward swing of the arm corresponding substantially in real time to the end of the forward stroke of the right leg, and vice versa. Each arm is therefore caused to be swung backwards approximately to the limit permissible without undue strain and, subsequently and in synchronism with the motion of the legs, swung forward to at least a substantially horizontal position. By carrying a rhythm indicator and exercising device 10 according to the present invention in each hand, grasped appropriately as illustrated relative to the right hand at FIGS. 8–10, at the end of the back swing of the arm, as shown more specifically at FIG. 8, the weighted mass 18 is caused by inertia to slide within the tubular member 12 until it impacts the rivet 14, or other stopping abutment member, thus emitting an impact noise. During forward swing of the arm, the weighted mass 18 remains engaged with the rear stop member or rivet 14, FIG. 9, until the arm reaches the end of its forward stroke, at which time, due to inertia, the weighted mass 18 is projected forward until impacting against the forward stopping abutment member or rivet 14, thus further producing another impact knock determining, time-wise, the end of the forward arm swing. In this manner, at least two important results are achieved. First, the user of the invention is able to determine, when an impact sound is emitted at each end of his arm swing, that sufficient swing of the arm has been achieved, and secondly, by synchronizing the impact sound of the weighted mass 18 striking the end stop or rivet 14, the person is enabled to establish and maintain an appropriate rhythmic or cadenced swinging of the arms to coincide appropriately with the cadence of the footsteps.

As shown at FIG. 11, the weighted mass 18, as an alternate to being a solid mass, can consist of a hollow member such as the cup-like member 44 provided with an integral end wall on one end, as shown at 46, and with a screw-on closure cap 48 on the other. By filling the interior of the cup member 44 with an appropriate amount of, for example, lead shots 48, the weighted mass 18 may adjustably be provided with any appropriate weight within a predetermined range. Alternatively, and as shown at FIG. 12, the weight of the weighted mass 18 may be made adjustable by forming the weighted mass of any appropriate number of separate elements 52, each provided on one end with a threaded bore 54 and on the other with a threaded stud 56 for threadable engagement with the threaded bore 54 of an additional separate element. A threaded ring 58 is conveniently used as an additional weight by being threadably mounted on the stud 56 of the last weight element 52.

FIG. 13 illustrates another example of weighted mass 18 in the form of a disk member 60 having a stem 62 projecting from one side. A plurality of spacer rings 64 are mounted around the stem 62 and can be replaced by any number of weight disks, such as weight disks 66, in order to adjustably vary the total weight of the mass 18, the assembly being held by means of a threaded retainer 70 threading on the threaded end 72 of the stem 62.

It will be appreciated that with a device according to the present invention provided with an adjustably variable weighted mass 18, structural example of which are illustrated at FIGS. 11–13, the load carried by the walker can be progressively increased as his or her physical stamina or endurance is progressively improved, and that, as an alternate to disposing within the bore 16 of the tubular mass 12 an adjustable weighted mass, the device of the invention can be supplied with a plurality of diverse weight slugs 20, and that several slugs, as illustrated at FIG. 4, may be disposed within a single tubular member 12. In structures of the invention provided with adjustably variable weighted mass, or with variety of slugs of different weights, one of the end closures for the tubular sleeve is made of a removable abutment member such as, for example, a screwed on end cap, or a rod-like stopping member in the form of a screw or in the form of a bolt and nut assembly.

The example of structure according to the present invention illustrated at FIG. 14 comprises a straight tubular member 12 which is provided on one side by finger-engaging indentations 26. The open end of the bore 16 in the tubular member 12 is closed by a cup-shaped cap 74 which is cemented in position over the edge of the tubular member 12 and which, in addition to acting as a closure cap, provides a safety retaining means in the unlikely event that the stop member, in the form of a metallic rod or rivet 14, breaks or is dislodged, preventing the weighted mass 18 from being projected accidentally from the open end of the bore 16. In addition, the rhythm indicator and exercising device 10 is provided at the closed end 30 of the tubular member 12 with an integrally molded projecting ring or ear 76 having an eyelet 78 through which is passed a loop, preferably adjustable in length, of narrow flat fabric or leather forming a sling 80. A user of the rhythm indicator and exercising device 10 of the invention passes his wrist through the sling 80, prior to manually grasping the peripheral surface of the tubular member 12. The weighted mass 18, loosely disposed within the bore 16 of the tubular member 12, is a metallic slug 82 which is generally shaped substantially as a knuckle bone, that is in the form of an elongated body having a plurality of rounded enlarged diameter portions 84 reducing substantially the friction between the peripheral surface of the slug 82 and the inner surface of the bore 16.

Figure 15:
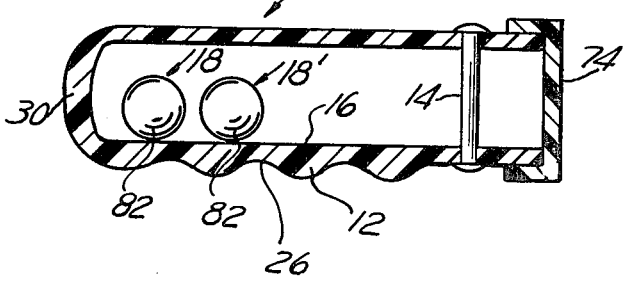

At FIG. 15, there is illustrated a further modification of the invention consisting generally of the same structure as disclosed at FIG. 14 with the sling 80 omitted, and wherein the weighted masses 18 and 18' consist of a pair of steel spherical balls 82.

Figure 16:
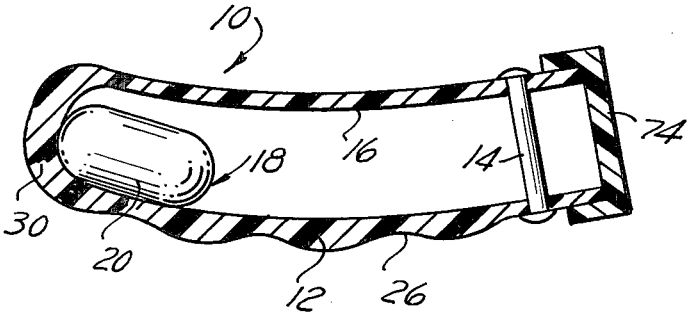
Figure 17:
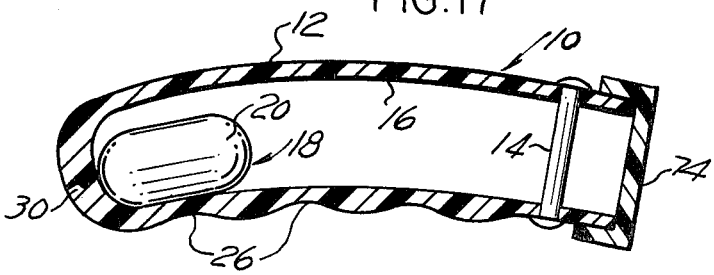

FIG. 16 illustrates a rhythm indicator and exercising device 10 according to the present invention consisting of a sleeveless tubular member 12 directly provided with an internal bore 16 and having a weighted mass 18 in the form of a slug 20 loosely disposed in the interior of the bore 16, a stop member in the form of an elongated rivet 14 and a fixed closure cap 74 diposed over the open end of a tubular member 12. However, instead of being straight the tubular member 12 is provided with a slight curvature which is upwardly directed at the ends of the tubular member 12 when the tubular member is normally grasped in a hand with the fingers of the hand passed through the indentations 26 directed downwardly. The structure of FIG. 17 is similar to that of FIG. 16 except that the curvature of the tubular member 12 is the inverse of that of the tubular member 12 of the structure of FIG. 16. It has been observed that the curved structures of FIGS. 16 and 17 present some advantages for users who do not attempt to maintain their hand at the wrist in a straight line with the arm, as they result in sharper impact sounds when the weighted mass 18, propelled by inertia, impacts upon the stop members at each end of the bore 16. In addition, it has been found that giving a slightly upwardly or downwardly curved shape to the tubular member 12 provides a more comfortable manual grasp to some users, due either to better match with the shape of the hand, or purely to psychological reasons.

Figure 18:
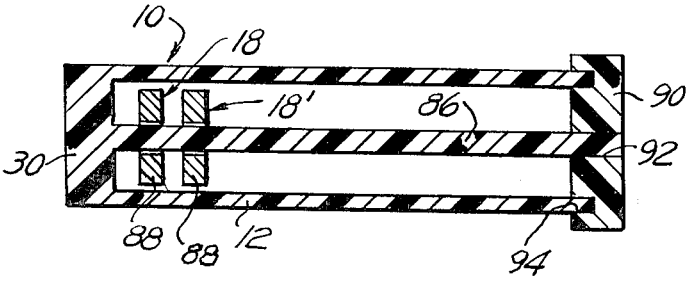

As hereinbefore disclosed and as illustrated in the drawing, the device of the invention may take any one of a plurality of shapes and structures. FIG. 18 illustrates a further example of structure consisting of a molded tubular member 12 closed at one end by an integral wall 30 and provided substantially along its center line with an integral rod member 86 around which are freely disposed a pair, or more, of weighted mass 18 and 18' in the form of metallic annular slugs 88. A stop member in the form of a closure cap 90 is fastened over the open end of the bore 16. The closure cap 90 is provided with a central aperture 92 through which projects the end of the rod 86, and with an annular groove 94 engaged over the edge of the open end of the tubular member 12, and an appropriate solvent or adhesive is used at the surfaces of the elements in mutual contact to securely cement the closure cap 90 in position.

Having thus described the invention by way of specific structural embodiments thereof, modification whereof will be apparent to those skilled in the art, what is claimed as new is as follows:

1. An exercising device comprising an elongated circularly cylindrical tubular member of appropriate outer diameter as to be gripped by a hand, said tubular member having a bore of substantially constant diameter extending from end to end of said tubular member, a freely movable weighted mass within the bore of said tubular member, said weighted mass having at least one dimension greater than one-half the diameter of said tubular member and being adapted to be slidably displaceable from end to end therein, and a rigid stop member disposed at an end of said tubular member for impacting by said weighted mass and for emitting an audible sound upon impact shock with said weighted mass.

2. The device of claim 1 wherein said tubular member is provided with an enclosure end wall at one end thereof.

3. The device of claim 1 wherein at least one of said stop members is a metallic disk fitted at one open end of said tubular member.

4. The device of claim 1 wherein said tubular member is enclosed in a grip-like sleeve.

5. The device of claim 4 wherein said grip-like sleeve is compressibly resilient.

6. The device of claim 1 wherein said weighted mass is a solid metallic slug.

7. The device of claim 1 wherein said weighted mass is in the form of at least two separate solid metallic slugs.

8. The device of claim 1 wherein said weighted mass is a hollow cup having an open end provided with a removable closure, and a plurality of metallic shots are disposed in said cup.

9. The device of claim 1 wherein said weighted mass comprises a plurality of separate weight members, and means for attaching together a plurality of said separate weight members for forming a weighted mass of appropriate weight.

10. The device of claim 1 further comprising a stationary rod member extending from end to end in said tubular member and wherein said weighted mass comprises at least one annular slug member freely disposed around said rod member.

11. The device of claim 1 wherein at least one of said ends of said tubular member is closed by a closure cap.

12. The device of claim 1 wherein said tubular member is straight.

13. The device of claim 1 wherein said tubular member is curvilinear.

14. The device of claim 1 further comprising a sling attached to said device for passage therethrough of the wrist of a user.

15. The device of claim 1 wherein said tubular member has a grip-like peripheral surface.

16. An exercising device comprising a tubular member of appropriate diameter as to be gripped by a hand, a freely movable weighted mass within said tubular member adapted to be displaceable from end to end therein, and stop members each disposed at an end of said tubular member for impacting by said weighted mass and for emitting an audible sound upon impact shock with said weighted mass, wherein at least one of said stop members is a rod diametrically disposed through said tubular member proximate one end thereof.

17. The device of claim 16 wherein said tubular member is provided with an enclosure end wall at one end thereof.

18. The device of claim 16 wherein at least one of said stop members is a metallic disk fitted at one open end of said tubular member.

19. The device of claim 16 wherein said tubular member is enclosed in a grip-like sleeve.

20. The device of claim 5 wherein said grip-like sleeve is compressibly resilient.

21. The device of claim 16 wherein said weighted mass is a solid metallic slug.

22. The device of claim 16 wherein said weighted mass is in the form of at least two separate solid metallic slugs.

23. The device of claim 16 wherein said weighted mass is a hollow cup having an open end provided with a removable closure, and a plurality of metallic shots are disposed in said cup.

24. The device of claim 16 wherein said weighted mass comprises a plurality of separate weight members, and means for attaching together a plurality of said separate weight members for forming a weighted mass of appropriate weight.

25. The device of claim 16 further comprising a stationary rod member extending from end to end in said tubular member and wherein said weighted mass comprises at least one annular slug member freely disposed around said rod member.

26. The device of claim 16 wherein at least one of said ends of said tubular member is closed by a closure cap.

27. The device of claim 16 wherein said tubular member is straight.

28. The device of claim 16 wherein said tubular member is curvilinear.

29. The device of claim 16 further comprising a sling attached to said device for passage therethrough of the wrist of a user.

30. The device of claim 16 wherein said tubular member has a grip-like peripheral surface.

* * * * *

UNITED STATES PATENT AND TRADEMARK OFFICE

CERTIFICATE OF CORRECTION

PATENT NO. : 4,278,248

DATED : July 14, 1981

INVENTOR(S) : Harry P. Kifferstein

It is certified that error appears in the above-identified patent and that said Letters Patent are hereby corrected as shown below:

Column 2, after line 66, insert --FIG. 4 is a longitudinal section through a further modification thereof;--

Column, 8, line 14, change "5" to --19--.

Signed and Sealed this

*Twenty-ninth* Day of *December 1981*

[SEAL]

*Attest:*

GERALD J. MOSSINGHOFF

*Attesting Officer*

*Commissioner of Patents and Trademarks*